US012788059B2

(12) United States Patent
Moloney et al.

(10) Patent No.: US 12,788,059 B2
(45) Date of Patent: Nov. 10, 2026

(54) CONSUMABLE ARTICLE FOR USE WITH AN APPARATUS FOR HEATING AEROSOLIZABLE MATERIAL

(71) Applicant: NICOVENTURES TRADING LIMITED, London (GB)

(72) Inventors: Patrick Moloney, London (GB); Anton Korus, London (GB); Justin Han Yang Chan, London (GB)

(73) Assignee: Nicoventures Trading Limited, London (GB)

( * ) Notice: Subject to any disclaimer, the term of this patent is extended or adjusted under 35 U.S.C. 154(b) by 564 days.

(21) Appl. No.: 17/753,940

(22) PCT Filed: Sep. 18, 2020

(86) PCT No.: PCT/EP2020/076175
§ 371 (c)(1),
(2) Date: Mar. 18, 2022

(87) PCT Pub. No.: WO2021/053184
PCT Pub. Date: Mar. 25, 2021

(65) Prior Publication Data

US 2023/0346018 A1 Nov. 2, 2023

(30) Foreign Application Priority Data

Sep. 18, 2019 (GB) ..... 1913479

(51) Int. Cl.
*A24F 40/42* (2020.01)
*A24F 40/465* (2020.01)
*A24F 40/51* (2020.01)

(52) U.S. Cl.
CPC ..... *A24F 40/42* (2020.01); *A24F 40/465* (2020.01); *A24F 40/51* (2020.01)

(58) Field of Classification Search
CPC ..... A24F 40/42
See application file for complete search history.

(56) References Cited

U.S. PATENT DOCUMENTS 3,140,611 A * 7/1964 Kliewer ..... G01K 13/10 99/421 TP
10,328,443 B2 * 6/2019 Ricketts ..... A24F 40/42
(Continued)

FOREIGN PATENT DOCUMENTS

CN 103826481 A 5/2014
CN 105072935 A 11/2015
(Continued)

OTHER PUBLICATIONS

CN-108349597-A, English machine translation—PE2E (Year: 2018).*
(Continued)

*Primary Examiner* — Michael H. Wilson
*Assistant Examiner* — Michael T Fulton
(74) *Attorney, Agent, or Firm* — Burr & Forman

(57) ABSTRACT

A consumable article for use with an apparatus arranged to heat aerosolizable material to volatilize at least one component of the aerosolizable material is disclosed. The consumable article includes a detectable element that is arranged in a first position prior to use of the consumable article. The detectable element is displaceable to a second position after use of the consumable article. In the first position the detectable element is detectable by the apparatus to enable the apparatus to heat the consumable article.

22 Claims, 4 Drawing Sheets

(56) References Cited

U.S. PATENT DOCUMENTS

| | | | | |
|---|---|---|---|---|
| 2008/0092912 | A1 | 4/2008 | Robinson et al. | |
| 2014/0253144 | A1 | 9/2014 | Novak, III et al. | |
| 2014/0338685 | A1 | 11/2014 | Amir | |
| 2015/0122274 | A1 | 5/2015 | Cohen et al. | |
| 2016/0198767 | A1 | 7/2016 | Verleur | |
| 2017/0202264 | A1* | 7/2017 | Makarewicz | A24F 15/005 |
| 2018/0153219 | A1 | 6/2018 | Verleur et al. | |
| 2018/0242638 | A1 | 8/2018 | Godfrey et al. | |
| 2018/0317557 | A1* | 11/2018 | Monsees | A61M 11/042 |
| 2019/0167923 | A1 | 6/2019 | Kessler et al. | |

FOREIGN PATENT DOCUMENTS

| | | | | | |
|---|---|---|---|---|---|
| CN | 108349597 | A | * | 7/2018 | A24F 40/485 |
| EP | 3135134 | A1 | | 3/2017 | |
| EP | 3407943 | A1 | | 12/2018 | |
| JP | 2002298669 | A | | 10/2002 | |
| JP | 2008543353 | A | | 12/2008 | |
| JP | 2009291282 | A | | 12/2009 | |
| JP | 2012516737 | A | | 7/2012 | |
| JP | 2013505037 | A | | 2/2013 | |
| JP | 2016103779 | A | | 6/2016 | |
| JP | 2017109040 | A | | 6/2017 | |
| JP | 2017538409 | A | | 12/2017 | |
| JP | 2018523986 | A | | 8/2018 | |
| JP | 2018529311 | A | | 10/2018 | |
| JP | 2018532985 | A | | 11/2018 | |
| JP | 2019521739 | A | | 8/2019 | |
| JP | 2020533995 | A | | 11/2020 | |
| RU | 61096 | U1 | | 2/2007 | |
| WO | 2014146270 | A1 | | 9/2014 | |
| WO | WO-2017084488 | A1 | * | 6/2017 | A24F 47/008 |
| WO | 2018069995 | A1 | | 4/2018 | |
| WO | WO-2019052748 | A1 | | 3/2019 | |

OTHER PUBLICATIONS

WO-2017084488-A1, English machine translation—PE2E (Year: 2017).*

International Preliminary Report on Patentability for Application No. PCT/EP2020/076175, mailed on Dec. 16, 2021, 8 pages.

International Search Report and Written Opinion for Application No. PCT/EP2020/076175, mailed on Jan. 12, 2021, 14 pages.

Written Opinion of the International Preliminary Examining Authority for Application No. PCT/EP2020/076175, mailed on Apr. 16, 2021, 5 pages.

Notice of reasons for refusal from corresponding JP Application No. 2024-061513, mailed Apr. 15, 2025, all pages cited in its entirety.

* cited by examiner

CONSUMABLE ARTICLE FOR USE WITH AN APPARATUS FOR HEATING AEROSOLIZABLE MATERIAL

PRIORITY CLAIM

The present application is a National Phase entry of PCT Application No. PCT/EP2020/076175, filed Sep. 18, 2020, which claims priority from GB Patent Application No. 1913479.0, filed Sep. 18, 2019, each of which is hereby fully incorporated herein by reference.

TECHNICAL FIELD

The present disclosure relates to a consumable article for use with an apparatus arranged to heat aerosolizable material.

BACKGROUND

Articles such as cigarettes, cigars and the like burn tobacco during use to create tobacco smoke. Attempts have been made to provide alternatives to these articles, which burn tobacco, by creating products that release compounds without burning. Examples of such products are so-called heat-not-burn products, also known as tobacco heating products or tobacco heating devices, which release compounds by heating, but not burning, the material. The material may be for example tobacco or other non-tobacco products or a combination, such as a blended mix, which may or may not contain nicotine.

SUMMARY

According to a first aspect of the present disclosure, there is provided a consumable article for use with an apparatus arranged to heat aerosolizable material to volatilize at least one component of the aerosolizable material, the consumable article comprising a detectable element, the detectable element being arranged in a first position prior to use of the consumable article and displaceable to a second position after use of the consumable article, wherein in the first position the detectable element is detectable by the apparatus to enable the apparatus to heat the consumable article.

Detection of the detectable element in the first position enables heating and therefore use of new or unspent consumable articles whereas detection that the detectable element is not in the first position, or a lack of detection of a detectable element, prevents heating by the apparatus, in the event that a new or unspent consumable article is not present at all, or that a used or incompatible consumable article is inserted into the apparatus.

In an exemplary embodiment, use of the consumable article causes the detectable element to be displaced from the first position to the second position.

In an exemplary embodiment, the consumable article comprises a displacement mechanism for displacing the detectable element from the first position to the second position.

In an exemplary embodiment, the displacement mechanism comprises a spring, the spring being pre-tensioned with the detectable element in the first position prior to use of the consumable article and arranged to displace the detectable element to the second position after use of the consumable article.

In an exemplary embodiment, the consumable article comprises a holding mechanism for holding the detectable element in the first position.

In an exemplary embodiment, the holding mechanism comprises a holding material that, in response to being heated, enables the detectable element to be displaced from the first position to the second position.

In an exemplary embodiment, the holding mechanism comprises a wax seal encapsulating the detectable element.

In an exemplary embodiment, wherein the holding material is arranged to soften or melt during use of the consumable article to allow the detectable element to be displaced to the second position.

In an exemplary embodiment, the consumable article comprises a susceptor material that is heatable by penetration with a varying magnetic field to heat the holding material.

In an exemplary embodiment, the holding material is arranged to be heated by heat used to volatilize the at least one component of the aerosolizable material.

In an exemplary embodiment, the holding mechanism comprises a mechanical lock.

In an exemplary embodiment, the mechanical lock is released upon insertion of the consumable article into the apparatus to allow the detectable element to be displaced to the second position.

In an exemplary embodiment, the consumable article comprises a memory arranged to store data indicative of a time elapsed following a first use of the consumable article in an apparatus and/or data indicative of a number of puffs have been drawn from the consumable article.

According to a second aspect of the present disclosure, there is provided an apparatus arranged to heat aerosolizable material to volatilize at least one component of the aerosolizable material, the apparatus being arranged to: receive a consumable article comprising the aerosolizable material; detect a displaceable detectable element in the consumable; and heat the consumable article based on the detection.

In an exemplary embodiment, the apparatus comprises: a sensor arranged to detect a signal from the detectable element; and a controller arranged to apply power to a heater element to heat the consumable article on the basis of the detected signal.

In an exemplary embodiment, in response to detection of a first signal, generated when the detectable element is in a first position in a consumable article received in the apparatus, the apparatus is configured to heat the consumable article; and in response to detection of a second signal, generated when the detectable element is in a second position in a consumable article received in the apparatus, different to the first position, the apparatus prevents heating of the consumable article.

In an exemplary embodiment, the sensor comprises a coil arranged to generate a magnetic field and to couple the magnetic field with the detectable element of an unused consumable article inserted into the apparatus.

In an exemplary embodiment, the controller is arranged to detect that the detectable element is in the first position based on a signal generated by the coil in response to an influence on the magnetic field by the detectable element.

In an exemplary embodiment, the coil is arranged to heat a susceptor material in the detectable element of a consumable article inserted in the apparatus.

In an exemplary embodiment, the apparatus is arranged to release the displaceable element of a consumable article, to displace the displaceable element from a first position to a second position, after a threshold period of time has elapsed following insertion of the consumable article in the apparatus and/or after a threshold number of puffs have been drawn from the consumable article.

In an exemplary embodiment, the apparatus comprises a memory arranged to store data indicative of a time elapsed following insertion of the consumable article in the apparatus and/or data indicative of a number of puffs have been drawn from the consumable article.

In an exemplary embodiment, the apparatus comprises a heating element arranged to volatilize at least one component of the aerosolizable material, wherein a detectable element in a consumable article received in the apparatus is heated by the heating element to release the detectable element to displace the displaceable element from a first position to a second position.

In an exemplary embodiment, the apparatus comprises an actuator arranged to release the detectable element such that the detectable element is displaced from a first position in the consumable article to a second position in the consumable article.

In an exemplary embodiment, the apparatus is arranged to prevent heating of the consumable article in the absence of a detection of the displaceable detectable element.

According to a third aspect of the present disclosure, there is provided a method of preventing heating of a consumable article for use with an apparatus arranged to heat aerosolizable material to volatilize at least one component of the aerosolizable material, the method comprising: providing, in the consumable article, a displaceable detectable element, the detectable element being arranged in a first position prior to use of the consumable article wherein in the first position the apparatus is arranged to heat the consumable article; and in response to use of the consumable article, displacing the detectable element to a second position in which the apparatus is arranged to prevent heating of the consumable article.

In an exemplary embodiment, the method comprises: applying heat to the consumable article in response to detection of the detectable article; and preventing application of heat to the consumable article in the absence of detection of the detectable element.

BRIEF DESCRIPTION OF THE DRAWINGS

Embodiments of the disclosure will now be described, by way of example only, with reference to the accompanying drawings, in which.

DETAILED DESCRIPTION

Apparatus is known that heats aerosolizable material to volatilize at least one component of the aerosolizable material, typically to form an aerosol which can be inhaled, without burning or combusting the aerosolizable material. Such apparatus is sometimes described as a "heat-not-burn" apparatus or a "tobacco heating product" or "tobacco heating device" or similar. Similarly, there are also so-called e-cigarette devices, which typically vaporize an aerosolizable material in the form of a liquid, which may or may not contain nicotine. The aerosolizable material may be in the form of or provided as part of a rod, cartridge or cassette or the like which can be inserted into the apparatus. A heating material for heating and volatilizing the aerosolizable material may be provided as a "permanent" part of the apparatus or may be provided as part of the consumable article which is discarded and replaced after use. A "consumable article" in this context is a device or article or other component that includes or contains in use the aerosolizable material, which in use is heated to volatilize the aerosolizable material.

As used herein, the term "aerosolizable material" includes materials that provide volatilized components upon heating, typically in the form of vapor or an aerosol. "Aerosolizable material" may be a non-tobacco-containing material or a tobacco-containing material. "Aerosolizable material" may, for example, include one or more of tobacco per se, tobacco derivatives, expanded tobacco, reconstituted tobacco, tobacco extract, homogenized tobacco or tobacco substitutes. The aerosolizable material can be in the form of ground tobacco, cut rag tobacco, extruded tobacco, reconstituted tobacco, reconstituted aerosolizable material, liquid, gel, gelled sheet, powder, or agglomerates, or the like. "Aerosolizable material" also may include other, non-tobacco products, which, depending on the product, may or may not contain nicotine. "Aerosolizable material" may comprise one or more humectants, such as glycerol or propylene glycol.

Figure 1A:
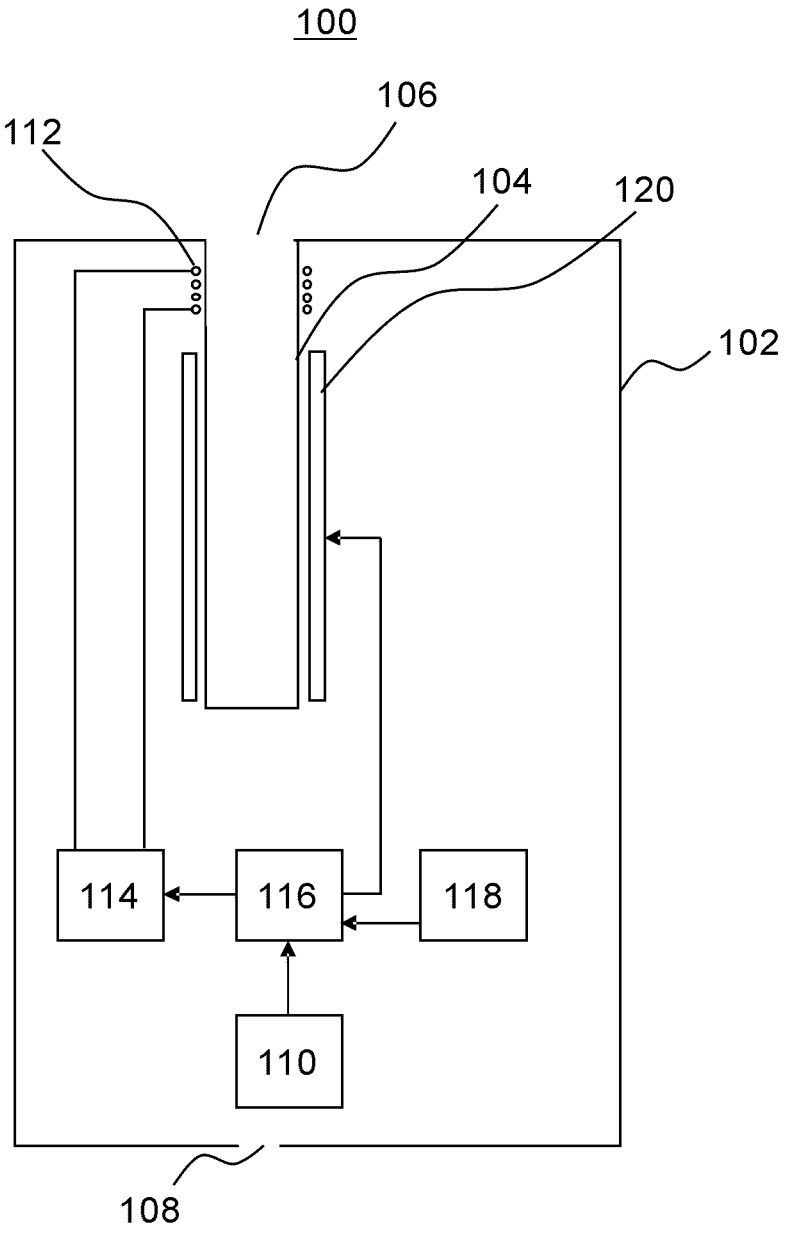
FIG. 1*a* shows a schematic cross-sectional view of an example of an apparatus for heating an aerosolizable material to volatilize at least one component of the aerosolizable material.

Referring to FIG. 1*a*, there is shown a schematic cross-sectional view of an example of apparatus 100 according to an embodiment of the disclosure. The apparatus 100 is for heating aerosolizable material to volatilize at least one component of the aerosolizable material.

The apparatus 100 comprises an apparatus housing 102, referred to hereinafter as a body 102. The body 102 comprises a heating zone 104 for receiving at least a portion of a consumable article (not shown in FIG. 1) comprising aerosolizable material that is to be heated. The apparatus 100 has an outlet 106 to permit volatilized components of the aerosolizable material to pass from the heating zone 104 towards an exterior of the apparatus 100 when, in use, the article is heated in the heating zone 104. In order to permit air to enter the apparatus 100 and be drawn through a consumable article inserted into the apparatus 100, the apparatus 100 may comprise one or more air inlets 108 located at a surface of the body 102, that are fluidically connected to a distal end of the heating zone 104. A user may be able to inhale the volatilized component(s) of the aerosolizable material by drawing the volatilized component(s) from the consumable article. As the volatilized component (s) are removed from the consumable article, air may be drawn into the heating zone 104 via the air inlet 108 of the apparatus 100.

In this embodiment, the heating zone 104 comprises a recess or cavity for receiving at least a portion of the consumable article. In other embodiments, the heating zone 104 may be other than a recess, such as a shelf, a surface, or a projection, and may require mechanical mating with the consumable article in order to co-operate with, or receive, the consumable article. In this embodiment, the heating zone 104 is elongate, and is sized and shaped to accommodate a portion of the consumable article such that a further portion of the consumable article protrudes from the body 102. In other embodiments, the heating zone 104 may be dimensioned to receive the whole of the consumable article.

The apparatus 100 comprises an electrical power source 110, a coil 112, a device 114 for passing a varying electrical current, such as an alternating current, through the coil 112, a controller 116, a user interface 118 for user-operation of the controller 116, and a heater 120.

The electrical power source 110 of this embodiment is a rechargeable battery. In other embodiments, the electrical power source 110 may be other than a rechargeable battery, such as a non-rechargeable battery, a capacitor, a battery-capacitor hybrid, or a connection to a mains electricity supply.

The electrical power source 110 is electrically coupled to the heater 120 to supply electrical power when required and under control of the controller 116 to heat the aerosolizable material (as described above, to volatilize the aerosolizable material without causing the aerosolizable material to burn). The electrical power source 110 is also electrically coupled, via the controller 116, to the device 114 for passing a varying electrical current through the coil 112 under the control of the controller 116.

As described below with reference to FIG. 1*b*, in use, a consumable article is inserted into the heating zone 104. In this embodiment, the heater 120 is generally in the form of a hollow cylindrical tube, having a hollow interior heating chamber into which aerosolizable material is inserted for heating in use. Different arrangements for the heater 120 are possible. For example, the heater 120 may be formed of a single heating element or may be formed of plural heating elements aligned along the longitudinal axis of the heater 120. The or each heating element may be annular or tubular, or at least part-annular or part-tubular around its circumference. In an example, the or each heating element may be a thin film heater. In another example, the or each heating element may be made of a ceramics material. Examples of suitable ceramics materials include alumina and aluminum nitride and silicon nitride ceramics, which may be laminated and sintered. Other heating arrangements are possible, including for example inductive heating, infrared heater elements, which heat by emitting infrared radiation, or resistive heating elements formed by for example a resistive electrical winding. In one particular example, the heater 120 is formed of a polyimide substrate on which is formed one or more heating elements, and which is supported by a stainless steel support tube. The heater 120 is dimensioned so that substantially the whole of the aerosolizable material when inserted is located within the heating element(s) of the heater 20 so that substantially the whole of the aerosolizable material is heated in use. The or each heating element may be arranged so that selected zones of the aerosolizable material can be independently heated, for example in turn (over time) or together (simultaneously) as desired.

In some embodiments, the heater 120 may be surrounded along at least part of its length by a thermal insulator to help to reduce heat passing from the heater 120 to the exterior of the apparatus 100. This helps to keep down the power requirements for the heater 120 as it reduces heat losses generally. The insulator may also help to keep the exterior of the apparatus 100 cool during operation of the heater 120. In one example, the insulator may be a double-walled sleeve which provides a low-pressure region between the two walls of the sleeve. That is, the insulator may be for example a "vacuum" tube, i.e. a tube that has been at least partially evacuated so as to minimize heat transfer by conduction and/or convection. Other arrangements for the insulator are possible, including using heat insulating materials, including for example a suitable foam-type material, in addition to or instead of a double-walled sleeve.

The coil 112 may take any suitable form. The coil 112 is sometimes referred to as a work coil. In this embodiment, the coil 112 is a helical coil of electrically-conductive material, such as copper. The coil 112 extends along a longitudinal axis that is substantially aligned with a longitudinal axis of the heating zone 104.

The device 114 for passing a varying current through the coil 112 is electrically connected between the electrical power source 110 and the coil 112. The controller 116 also is electrically connected to the electrical power source 110, and is communicatively connected to the device 114 to control the device 114. More specifically, the controller 116 is for controlling the device 114, so as to control the supply of electrical power from the electrical power source 110 to the coil 112 and to determine a presence or otherwise of a detectable element in a consumable article on the basis of a measured property of the coil 112 or a signal generated by and/or returned from the coil 112 in response to an influence on the magnetic field by the detectable element. The controller 116 may, for example, comprise an integrated circuit (IC), such as an IC on a printed circuit board (PCB). In some embodiments, the apparatus 100 may have a single electrical or electronic component comprising the device 114 and the controller 116.

The controller 116 is arranged to control a supply of electrical power from the electrical power source 110 to the heater 120 based on a determination of whether a detectable element in a consumable article is detected to be in a predetermined position.

In use, the controller 116 is operated by user-operation of the user interface 118. The user interface 118 is located at the exterior of the body 102. The user interface 118 may, for example, comprise a push-button, a toggle switch, a dial, a touchscreen, or the like. In other implementations, the controller 116 may be configured to operate in response to a detectable condition, detected via a suitable sensor, such as when a user inhales on the apparatus 100.

When an unused consumable article is inserted into the apparatus 100, the controller 116 is able to detect a displaceable detectable element in the consumable article is in a predetermined position. Upon detection of the detectable element in the predetermined position, operation of the user interface 118 by a user or detection of a user inhaling on the apparatus, causes the controller 116 to cause the power to be supplied from the power supply 110 to the heater 120. However, use of the consumable article causes the detectable element to be displaced from the predetermined position (i.e. from first position to a second position). If a used consumable article is subsequently inserted into the apparatus 100 (or another similar apparatus), the controller 116 does not detect that the detectable element is in the predetermined position or is unable to detect a detectable element in the consumable article at all. In such circumstances, the controller 116 may be configured to prevent heating of the consumable article, and/or may perform certain other actions such as providing a signal/warning to the user. For example, if the apparatus 100 receives a consumable article has been used such that, as described below with reference to FIGS. 3*a* to 4*b*, the detectable element has been displaced, the controller 116 may detect that the detectable element is displaced, or may detect that there is no detectable element, and will accordingly prevent power being supplied to the heater 120. Similarly, if an incompatible consumable article (i.e. that does not include a detectable element) is inserted into the apparatus 100, the controller 116 will not detect the presence of a detectable element and will accordingly prevent power being supplied to the heater 120.

In some embodiments, the apparatus 100 may comprise a temperature sensor for sensing a temperature of the heating zone 104. The temperature sensor may be communicatively connected to the controller 116, so that the controller 116 is able to monitor the temperature of the heating zone 104. On the basis of one or more signals received from the temperature sensor 120, the controller 116 may cause the device 114 to adjust a characteristic of the power supplied to the heater 120 as necessary, in order to ensure that the temperature of the heating zone 104 remains within a predetermined temperature range. Within the predetermined temperature range, in use the aerosolizable material within a consumable article located in the heating zone 104 is heated sufficiently to volatilize at least one component of the aerosolizable material without combusting the aerosolizable material. Accordingly, the controller 116, and the apparatus 100 as a whole, is arranged to heat the aerosolizable material to volatilize the at least one component of the aerosolizable material without combusting the aerosolizable material. In some embodiments, the temperature range is about 50° C. to about 300° C., such as between about 50° C. and about 250° C., between about 60° C. and about 240° C., between about 70° C. and about 230° C., between about 80° C. and about 220° C., between about 90° C. and about 210° C., or between about 100° C. and about 200° C. In some embodiments, the temperature range is between about 170° C. and about 220° C. In other embodiments, the temperature range may be other than this range. In some embodiments, the upper limit of the temperature range could be greater than 300° C. In some embodiments, the temperature sensor may be omitted. In some embodiments, the heating material may have a Curie point temperature selected on the basis of the maximum temperature to which it is desired to heat the heating material, so that further heating above that temperature by induction heating the heating material is hindered or prevented.

Figure 1B:
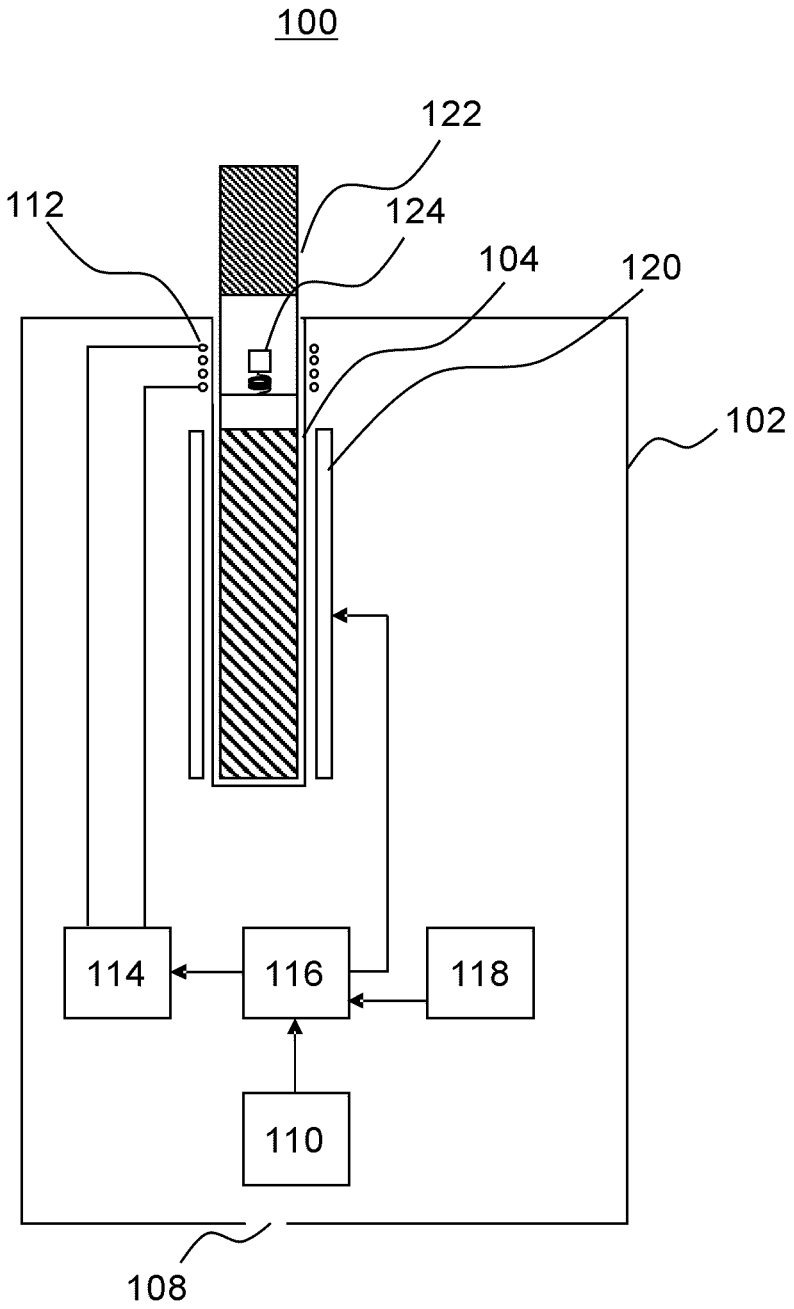
FIG. 1*b* shows a schematic cross-sectional view of an example of an apparatus for heating an aerosolizable material with a consumable article inserted in the apparatus.

As shown in FIG. 1*b*, there is shown a schematic cross-sectional view of an example of apparatus 100 with a consumable article 122 inserted into the apparatus 100. As shown in FIG. 1*b*, when the consumable article 122 is inserted into the apparatus 100, a detectable element 124 in the consumable article 122 aligns with the coil 112, which acts as a sensor for detecting the detectable element 124. The coil 112 may be provided with a predetermined electrical current or voltage. When the detectable element 124 is aligned with the coil 112, inductive coupling may occur between the detectable element 124 and the coil 112, which manifests itself as a variation on the predetermined electrical current or voltage. The apparatus 100 is arranged to detect the presence or otherwise of the detectable element 124 in a predetermined position in the consumable article 122, and to allow heating of the consumable article 122 on the basis of the detection (i.e. on the basis of an output from the sensor). For example, in response to detecting the presence of the detectable element 122, the controller 116 of the apparatus 100 may, in response to an appropriate input received at the user interface 118, provide power to the heater 120 and, in the absence of a detection of the detectable element in a predetermined position, to prevent heating of the consumable article (by preventing power being supplied to the heater 120.

Figure 2:
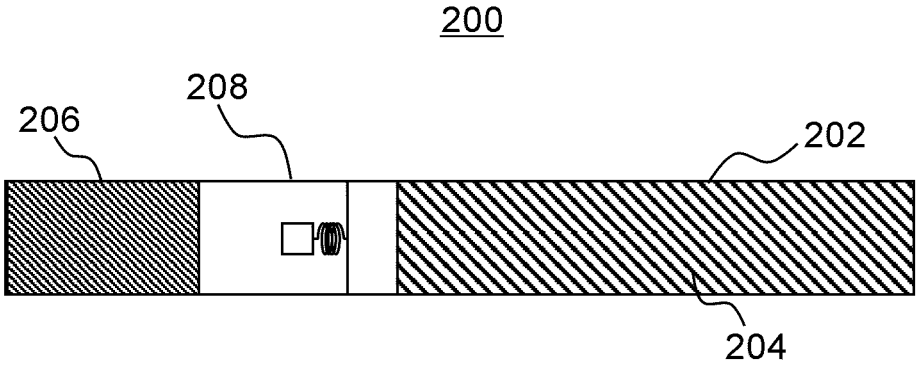
FIG. 2 shows a schematic cross-sectional view of a consumable article.

Referring to FIG. 2, there is shown an apparatus which is a consumable article 200 for use with an apparatus arranged to heat aerosolizable material to volatilize at least one component of the aerosolizable material, such as the apparatus 100 described above with reference to FIG. 1, according to an embodiment of the disclosure.

The consumable article 200 may be provided with a substrate 202 comprising aerosolizable material. For example, the substrate 202 may comprise, tobacco, tobacco derivatives, expanded tobacco, reconstituted tobacco, tobacco extract, homogenized tobacco or tobacco substitutes may be located within a shell 204, as described above. Alternatively, the substrate 202 may comprise non-tobacco products, which, depending on the product, may or may not contain nicotine. The shell 204 may be formed of a substrate material, such as a paper material or a cardboard material, for example.

In the embodiment shown in FIG. 2, the consumable article 200 comprises a filter portion 206. For example, the filter portion 206 may comprise filtering material such as cellulose acetate fiber. The filter portion 206 may, in use, act as a mouthpiece for the consumable article 200, through which air containing volatilized components from the aerosolizable material may be drawn. At the opposite end of the consumable article 200 from the filter portion, at what is sometimes referred to as a distal end, there is an opening into which air can be drawn to then be drawn through the consumable article 200.

In other embodiments, the filter portion 206 may be omitted. For example, in some embodiments, the consumable article 200 may be contained entirely within an apparatus and the apparatus may be provided with a mouthpiece via which a user may draw air containing volatilized components from the aerosolizable material.

The consumable article 200 comprises an activation element 208 which, as described below with reference to FIGS. 3*a* to 4*b* comprises a detectable element that is displaceable from a first position to a second position. The activation element 208 is supplied (i.e. in an unused state) with the detectable element in the first position. In the first position, the detectable element of the activation element 208 is detectable by the apparatus to enable the apparatus to heat the consumable article 200. In the second position, the detectable element of the activation element 208 is displaced so that the apparatus detects that the consumable is used or so that the detectable element is undetectable by the apparatus thereby preventing heating of the consumable article 200.

In some embodiments, the consumable article 200 may comprise an integral heating element to heat aerosolizable material in the substrate 204 to volatilize at least one component of the aerosolizable material, rather than being heated directly by a heating element within the apparatus in which it is used.

Figure 3A:
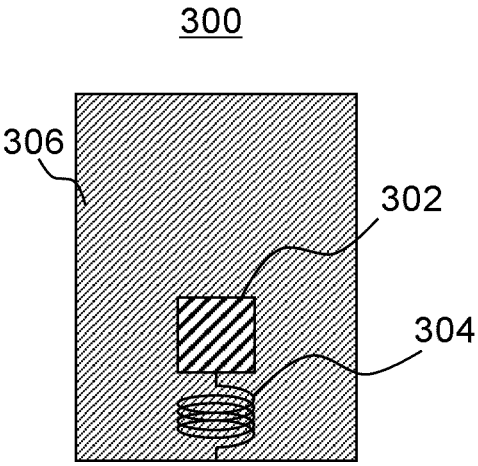
FIG. 3*a* shows a schematic cross-sectional view of an activation element of a consumable article in which a detectable element is in a first position.
Figure 3B:
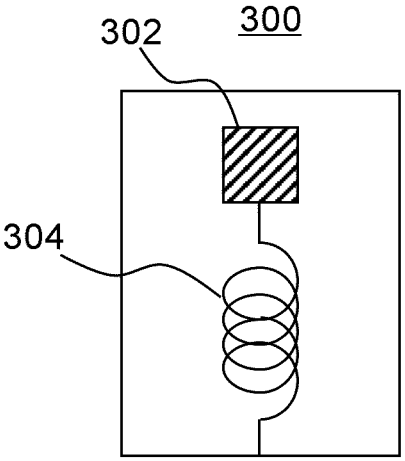
FIG. 3*b* shows a schematic cross-sectional view of an activation element of a consumable article in which a detectable element is in a second position.

Referring to FIGS. 3*a* and 3*b*, there are shown schematic cross-sectional views of an activation element 300, which may be used as the activation element in a consumable article such as activation element 208 in the consumable article 200 disclosed above with reference to FIG. 2.

The activation element 300 comprises a displaceable detectable element 302 and a displacement mechanism, which in the embodiment shown comprises a spring 304. The activation element 300 also comprises a holding mechanism for holding the detectable element 302 in the first position.

FIG. 3*a* shows the activation element 300 with the displaceable detectable element 302 in a first position, corresponding to a position in which it would be prior to use of the consumable article 200. FIG. 3*b* shows the activation element 300 with the displaceable detectable element 302 in a second, displaced, position corresponding to a position in which it would be after use of the consumable article 200.

As shown in FIG. 3*a*, when the consumable article 200 is in an unused state, the detectable element 302 is in the first position with the spring 304 in a pre-tensioned state. In this embodiment, the holding mechanism for holding the detectable element 302 and the spring 304 in place (i.e. with the detectable element in the first position and the spring pre-tensioned) comprises a holding material 306 that, in response to being heated, enables the detectable element 302 to be displaced from the first position to the second position. For example, the holding material may be a wax seal that when heated softens or melts thereby enabling the detectable element 302 to be displaced from the first position to the second position under the influence of the spring 304. In other embodiments, the holding material 306 may be a plastics material or any other material which may soften or melt in response to application of heat at an appropriate temperature.

After insertion of the consumable article 200 into the apparatus 100 and use of the consumable article 200 (i.e. heating of the consumable article 200 to heat the aerosolizable material), the detectable element 302 may be displaced to the second position as shown in FIG. 3*b*.

In the embodiment shown in FIG. 3*b*, upon, after or during use of the consumable article 200, the holding material 306 is softened or melted. Once the holding material 306 has softened or melted sufficiently, the tension in the spring 304 forces the detectable element 302 to be displaced from the first position, in which it can be detected by the controller 116 of the apparatus 100 to enable the controller 116 to heat the consumable article 200, to the second position. As the detectable element 302 cannot be returned to the first position since it is held in the second position by the spring 304, if the consumable article 200 is subsequently reinserted into the apparatus 100, or is inserted into a different apparatus 100, the controller 116 of the apparatus 100 will detect that the detectable element 302 is not in the first position, or will be unable to detect the detectable element 302, and will not enable power to be supplied to the heater 120, thereby preventing further heating of the consumable article 200.

In the embodiment shown in FIGS. 3*a* and 3*b*, the detectable element 302 is a heating material, sometimes referred to as a susceptor material, that is heatable by penetration of with a varying magnetic field, such as the field generated by the coil 112 of the apparatus 100. In the embodiment shown in FIGS. 3*a* and 3*b*, the detectable element 302 responds to the penetrating magnetic field by heating the holding material 306 to soften or melt the holding material 306. Once the holding material 306 has softened or melted sufficiently, the detectable element 302 is able to be displaced, under the action of the spring 304, from the first position to the second position. An impedance of the coil 112 of the apparatus 100 may be equal, or substantially equal, to an impedance of the detectable element 302.

Induction heating is a process in which an electrically-conductive object is heated by penetrating the object with a varying magnetic field. The process is described by Faraday's law of induction and Ohm's law. An induction heater may comprise an electromagnet and a device for passing a varying electrical current, such as an alternating current, through the electromagnet. When the electromagnet and the object to be heated are suitably relatively positioned so that the resultant varying magnetic field produced by the electromagnet penetrates the object, one or more eddy currents are generated inside the object. The object has a resistance to the flow of electrical currents. Therefore, when such eddy currents are generated in the object, their flow against the electrical resistance of the object causes the object to be heated. An object that is capable of being inductively heated is known as a susceptor.

In some embodiments, heating of the detectable element 302 of an unused consumable article 200 begins as soon as the consumable article 200 is inserted into the apparatus 100 and a user uses the apparatus 100 to heat the consumable article 200 (for example, by input applied to the user interface 118). In such embodiments, the controller 116 may be arranged to initially detect the presence of the detectable element 302 in the first position and, for example, permit heating of the consumable article 200 for a predetermined time following the initial detection, or for a predetermined number of "puffs". The apparatus 100 and/or the consumable article 200 may include a storage device (i.e. a memory device) arranged to store data indicative of a time elapsed following insertion of the consumable article in the apparatus and/or data indicative of a number of puffs have been drawn from the consumable article 200. At the end of a use session (i.e. after a certain number of puffs have been taken, or after a certain amount of time since activation has elapsed), the controller 116 may be arranged to prevent further heating of the consumable article 200. For example, based on data stored in the apparatus 100 or the consumable article 200, the controller 116 may determine that the consumable article 200 is used.

In other embodiments, a heat capacity of the holding material 306, and the dimensions of the holding material 306, may be designed such that the integrity of the holding material 306 is maintained for a predetermined amount of heating time, after which the holding material 306 softens or melts to a degree that allows the detectable element 302 to be displaced to the second position. In such embodiments, the controller 116 may be arranged to continually monitor for the presence of the detectable element 302 in the first position and permit heating of the consumable article 200 only while the controller 116 detects the presence of the detectable element 302 in the first position.

In some embodiments, the detectable element 302 may not provide any heating of the holding material 306. For example, heating and softening or melting of the holding material 306 may instead be provided by heat from the flow of gases passing through the consumable article 100 or from the conduction of heat along the consumable article 200 (i.e. indirectly from the heat generated by the heater 120 that is used to volatilize a component of the aerosolizable material). Alternatively, the activation element 300 may be provided with a heating element, separate from the detectable element 302, which may be heated by inductive or resistive heating.

Figure 4A:
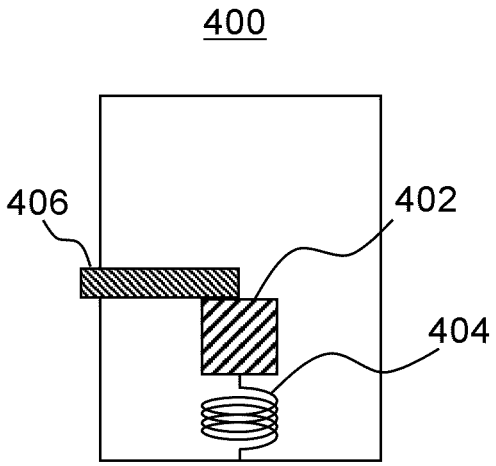
FIG. 4*a* shows a schematic cross-sectional view of an activation element of a consumable article in which a detectable element is in a first position.
Figure 4B:
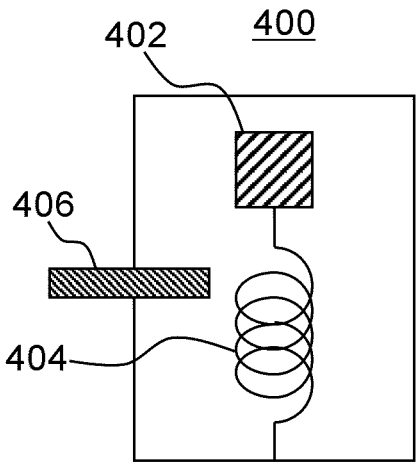
FIG. 4*b* shows a schematic cross-sectional view of an activation element of a consumable article in which a detectable element is in a second position.

Referring to FIGS. 4*a* and 4*b*, there are shown schematic cross-sectional views of an activation element 400, which may be used as the activation element in a consumable article such as activation element 208 in the consumable article 200 disclosed above with reference to FIG. 2.

Similar to the activation element 300 disclosed above with reference to FIGS. 3*a* and 3*b*, the activation element 400 shown in FIGS. 4*a* and 4*b* comprises a displaceable detectable element 402 and a displacement device, which in the embodiment shown comprises a spring 404. The activation element 400 also comprises a holding mechanism for holding the detectable element 402 in the first position.

FIG. 4*a* shows the activation element 400 with the displaceable detectable element 402 in a first position, corresponding to a position in which it would be prior to use of the consumable article 200. FIG. 4*b* shows the activation element 400 with the displaceable detectable element 402 in a second, displaced, position corresponding to a position in which it would be after use of the consumable article 200.

As shown in FIG. 4*a*, when the consumable article 200 is in an unused state, the detectable element 402 is in the first position with the spring 404 in a pre-tensioned state. The holding mechanism for holding the detectable element 402 and the spring 404 in place with the detectable element in the first position and the spring pre-tensioned is a mechanical lock 406.

After insertion of the consumable article 200 into the apparatus 100, the mechanical lock 406 may be triggered to release the tension in the spring 404 so that the detectable element 402 may be displaced to the second position as shown in FIG. 4*b*. For example, the apparatus 100 may comprise an actuator arranged to engage with and release the lock upon insertion of the consumable article 200 into the apparatus 100 to allow the detectable element 402 to be displaced to the second position.

Once the mechanical lock 406 has been released, the tension in the spring 404 forces the detectable element 402 to be displaced from the first position, in which it can be detected by the controller 116 of the apparatus 100 to enable the controller 116 to heat the consumable article 200, to the second position. As the detectable element 402 cannot be returned to the first position since it is held in the second position by the spring 404, if the consumable article 200 is subsequently reinserted into the apparatus 100, or is inserted into a different apparatus 100, the controller 116 of the apparatus 100 will detect that the detectable element 302 is not in the first position, or will be unable to detect the detectable element 402, and will not enable power to be supplied to the heater 120, thereby preventing further heating of the consumable article 200.

Figure 5:
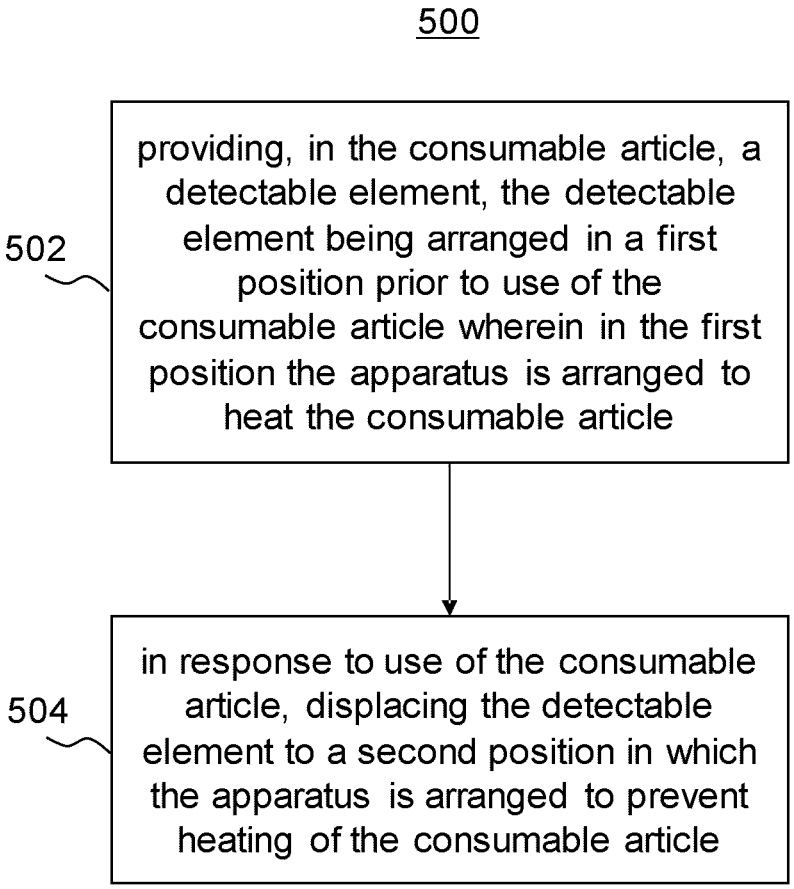
FIG. 5 shows a flow diagram illustrating a method of preventing heating of a consumable article.

Referring to FIG. 5, there is shown a method 500 of preventing heating of a consumable article, such as the consumable article 200 described above with reference to FIG. 2.

At block 502, a displaceable detectable element, such as the detectable elements 300, 400 described above with reference to FIGS. 3*a* to 4*b*, is provided in the consumable article. The detectable element is arranged in a first position prior to use of the consumable article, in which the apparatus is arranged to heat the consumable article.

At block 504, in response to use of the consumable article, the detectable element is displaced to a second position in which the apparatus is arranged to prevent heating of the consumable article.

Although in the embodiments described above with reference to FIGS. 1 to 5, heating of the aerosolizable material to volatilize at least one component of the aerosolizable material is provided by a resistive heating arrangement provided within the apparatus, in some embodiments heating may be provided by other heating arrangements instead of or in addition to a resistive heater in the apparatus. For example, the consumable article may be provided with a resistive heating arrangement instead of, or in addition to a resistive heater provided in the apparatus. Alternatively, an inductive heating arrangement may be provided within the consumable article that is heated by an induction coil provided within the apparatus. In other examples, the apparatus arranged to heat aerosolizable material may comprise a heating arrangement to heat the aerosolizable material by radiative heating (i.e. by infrared radiation).

Although the embodiments disclosed above are described with reference to a heat-not-burn device that heats a tobacco containing consumable article, in some embodiments the apparatus may be an electronic cigarette (e-cigarette) and the consumable article may be a container arranged to contain, for example, an aerosolizable liquid which may be heated to volatize one or more components of the aerosolizable liquid. For example, the consumable article may be a cartomizer cartridge for use with an e-cigarette.

The various embodiments described herein are presented only to assist in understanding and teaching the claimed features. These embodiments are provided as a representative sample of embodiments only and are not exhaustive and/or exclusive. It is to be understood that advantages, embodiments, examples, functions, features, structures, and/or other aspects described herein are not to be considered limitations on the scope of the invention as defined by the claims or limitations on equivalents to the claims, and that other embodiments may be utilized, and modifications may be made without departing from the scope of the claimed invention. Various embodiments of the invention may suitably comprise, consist of, or consist essentially of, appropriate combinations of the disclosed elements, components, features, parts, steps, means, etc., other than those specifically described herein. In addition, this disclosure may include other inventions not presently claimed, but which may be claimed in future.

The invention claimed is:

1. A consumable article for use with an apparatus arranged to heat aerosolizable material to volatilize at least one component of the aerosolizable material, the consumable article comprising:

a detectable element being arranged in a first position prior to use of the consumable article and displaceable to a second position after use of the consumable article, and a displacement mechanism for displacing the detectable element from the first position to the second position, wherein in the first position the detectable element is detectable by the apparatus to enable the apparatus to heat the consumable article, wherein use of the consumable article causes the detectable element to be displaced from the first position to the second position, wherein the displacement mechanism comprises a spring, the spring being pre-tensioned with the detectable element in the first position prior to use of the consumable article and arranged to displace the detectable element to the second position after use of the consumable article, further comprising a holding mechanism for holding the detectable element in the first position and the spring pre-tensioned, wherein the holding mechanism comprises a holding material that, in response to being heated, enables the detectable element to be displaced from the first position to the second position under the influence of the spring.

2. The consumable article according to claim 1, wherein the holding mechanism comprises a wax seal encapsulating the detectable element.

3. The consumable article according to claim 2, wherein the holding material is arranged to soften or melt during use of the consumable article to allow the detectable element to be displaced to the second position.

4. The consumable article according to claim 1, comprising a susceptor material that is heatable by penetration with a varying magnetic field to heat the holding material.

5. The consumable article according to claim 1, wherein the holding material is arranged to be heated by heat used to volatilize the at least one component of the aerosolizable material.

6. The consumable article according to claim 1, further comprising a memory arranged to store at least one of data indicative of a time elapsed following a first use of the consumable article in an apparatus or data indicative of a number of puffs that have been drawn from the consumable article.

7. The consumable article according to claim 1, wherein use of the consumable article comprises heating of the consumable article to heat the aerosolizable material.

8. The consumable article according to claim 1, wherein the holding material is arranged to soften or melt during use of the consumable article to allow the detectable element to be displaced to the second position.

9. The consumable article according to claim 1, further comprising an integral heating element to heat the aerosolizable material.

10. A method of preventing heating of a consumable article for use with an apparatus arranged to heat aerosolizable material to volatilize at least one component of the aerosolizable material, the method comprising:

providing a consumable article according to claim 1, the detectable element being arranged in the first position prior to use of the consumable article, wherein in the first position the apparatus is arranged to heat the consumable article; and in response to use of the consumable article, displacing the detectable element to the second position in which the apparatus is arranged to prevent heating of the consumable article.

11. The method according to claim 10, further comprising:

applying heat to the consumable article in response to detection of the detectable article; and preventing application of heat to the consumable article in the absence of detection of the detectable element.

12. A system comprising an apparatus arranged to heat aerosolizable material to volatilize at least one component of the aerosolizable material, the apparatus comprising a consumable article arranged to heat the aerosolizable material to volatilize at least one component of the aerosolizable material, the consumable article comprising:

a detectable element being arranged in a first position prior to use of the consumable article and displaceable to a second position after use of the consumable article, and a displacement mechanism for displacing the detectable element from the first position to the second position, wherein in the first position the detectable element is detectable by the apparatus to enable the apparatus to heat the consumable article, wherein use of the consumable article causes the detectable element to be displaced from the first position to the second position, wherein the displacement mechanism comprises a spring, the spring being pre-tensioned with the detectable element in the first position prior to use of the consumable article and arranged to displace the detectable element to the second position after use of the consumable article, further comprising a holding mechanism for holding the detectable element in the first position and the spring pre-tensioned, wherein the holding mechanism comprises a holding material that, in response to being heated, enables the detectable element to be displaced from the first position to the second position under the influence of the spring, the apparatus being arranged to:

receive the consumable article comprising the aerosolizable material;

detect the detectable element in the consumable article; and heat the consumable article based on the detection.

13. The system according to claim 12, wherein the apparatus comprises:

a sensor arranged to detect a signal from the detectable element; and a controller arranged to apply power to a heater element to heat the consumable article based on the basis of the detected signal.

14. The system according to claim 13, wherein:

in the first position the apparatus detects a first signal from the displaceable detectable element and, in response to detection of the first signal, the apparatus is configured to heat the consumable article; and in the second position the apparatus detects a second signal different to the first signal and, in response to detection of the second signal, the apparatus prevents heating of the consumable article.

15. The system according to claim 13, wherein the sensor comprises a coil arranged to generate a magnetic field and to couple the magnetic field with the detectable element of an unused consumable article inserted into the apparatus.

16. The system according to claim 15, wherein the controller is arranged to detect that the detectable element is in the first position based on a signal generated by the coil in response to an influence on the magnetic field by the detectable element.

17. The system according to claim 16, wherein the coil is arranged to heat a susceptor material in the detectable element of a consumable article inserted in the apparatus.

18. The system according to claim 12, wherein the apparatus is arranged to release the displaceable element of a consumable article, to displace the displaceable element from a first position to a second position, after one or more of a threshold period of time has elapsed following insertion of the consumable article in the apparatus or a threshold number of puffs that have been drawn from the consumable article.

19. The system according to claim 18, the apparatus further comprising a memory arranged to store at least one of data indicative of a time elapsed following insertion of the consumable article in the apparatus or data indicative of a number of puffs that have been drawn from the consumable article.

20. The system according to claim 12, the apparatus further comprising a heating element arranged to volatilize at least one component of the aerosolizable material, wherein the detectable element in the consumable article received in the apparatus is heated by the heating element to release the detectable element to displace the displaceable element from a first position to a second position.

21. The system according to claim 12, the apparatus further comprising an actuator arranged to release the detectable element such that the detectable element is displaced from a first position in the consumable article to a second position in the consumable article.

22. The system according to claim 12, the apparatus arranged to prevent heating of the consumable article in the absence of a detection of the displaceable detectable element.

* * * * *